US005529436A

United States Patent [19]

Meyers

[11] Patent Number: 5,529,436

[45] Date of Patent: Jun. 25, 1996

[54] TRENCH DRAIN SYSTEM

[75] Inventor: Theodore W. Meyers, Inverness, Ill.

[73] Assignee: Tuf-Tite, Inc., Wauconda, Ill.

[21] Appl. No.: 240,992

[22] Filed: May 11, 1994

[51] Int. Cl.[6] ..... E02B 5/00

[52] U.S. Cl. ..... 405/119; 404/4; 405/118

[58] Field of Search ..... 405/118–122; 404/2–4; 249/9–13

[56] References Cited

U.S. PATENT DOCUMENTS

| | | | |
|---|---|---|---|
| Re. 26,366 | 4/1968 | Flegel . | |
| Re. 32,248 | 9/1986 | Blecher | 210/163 |
| Re. 33,439 | 11/1990 | Thomann et al. | 404/2 |
| D. 242,622 | 12/1976 | Ito | D25/73 |
| D. 242,623 | 12/1976 | Ito | D25/73 |
| D. 243,094 | 1/1977 | Ito | D25/73 |
| D. 299,543 | 1/1989 | Phillips | D25/35 |
| D. 312,696 | 12/1990 | Phillips | D25/35 |
| 643,677 | 2/1900 | Payne | 405/121 X |
| 1,406,068 | 2/1922 | Padgett . | |
| 2,386,020 | 5/1943 | Wendelken . | |
| 2,419,996 | 5/1947 | Honikman | 405/119 X |
| 2,436,593 | 2/1948 | Moselowitz . | |
| 2,701,027 | 10/1952 | Scoville | 182/31 |
| 2,938,437 | 5/1958 | Daley . | |
| 3,225,545 | 12/1965 | Flegel . | |

(List continued on next page.)

FOREIGN PATENT DOCUMENTS

| | | |
|---|---|---|
| 3634289-A1 | 4/1988 | Germany . |
| 1071497 | 6/1967 | United Kingdom . |
| 2222624 | 3/1990 | United Kingdom . |

OTHER PUBLICATIONS

"Modern Solutions to An Age–Old Problem", Aquaduct, Inc., product publication, 1994.

Two Tuf–Tite photographs dated Feb. 15, 1987.

Tuf–Tite Drain Sump brochure dated with a copyright of 1990.

Polydrain commercial brochure entitled Polydrain. Surface Drainage Made Simple. "Printed" date of Sep. 1983.

(List continued on next page.)

*Primary Examiner*—Dennis L. Taylor

*Attorney, Agent, or Firm*—Tilton, Fallon, Lungmus & Chestnut

[57] ABSTRACT

An improved trench drain or so-called channel drain system is disclosed which provides a universal drainage unit, preferably formed of injection molded plastic in a standard length, for installation in concrete floors, airport areas, driveways, service station aprons, EPA-mandated on-site collection and disposal areas, and the like. The trench drain unit terminates at one end in a female end and at the other end in a male end. Such drain ends can respectively receive male and female end caps, whereby the drain operates as a single unit drain, or instead can receive the molded interlocking male and female ends of an adjacent trench drain unit, whereby a connected series drain system is created. The mating interlocking male and female ends so encapsulate one another as to create a substantially watertight connection. Drain openings covered by knock-out membranes, with downwardly-extending pipe flange connectors, are located proximal each respective end of the universal drain unit. The flange connectors facilitate connection to commercially available plastic drainpipes and connector components. When a trench drain unit is transversely sawn, i.e., field cut, to a desired terminal length, then essentially regardless where cut, it provides a female end capable of receiving a standard male end cap. Upstanding lugs formed on grate support ledges of the upper respective channel walls are received in slotted openings of the associated grate member. This cooperative engagement prevents any unwanted lateral expansion, i.e., spreading, of the channel side walls. The present trench drain unit, which is preferably installed flush with the floor, drains to a buried supplemental pipe having a suitable pitch. An alternate male end cap, i.e., a male end cap drain, is disclosed as having an opening encompassed by a pipe connector flange for permitting end-draining, that is draining out the terminal end of a trench drain unit when the particular installation application so requires.

48 Claims, 5 Drawing Sheets

U.S. PATENT DOCUMENTS

| | | | |
|---|---|---|---|
| 3,465,654 | 7/1967 | Fox . | |
| 3,788,756 | 1/1974 | Ito | 404/4 |
| 3,876,322 | 4/1975 | Deason | 404/2 |
| 4,190,988 | 3/1980 | Carreiro | 52/16 |
| 4,490,067 | 12/1984 | Dahowski | 404/4 |
| 4,498,807 | 2/1985 | Kirkpatrick et al. | 405/43 |
| 4,515,498 | 5/1985 | Thomann et al. | 404/4 |
| 4,553,874 | 11/1985 | Thomann et al. | 404/4 |
| 4,621,939 | 11/1986 | Thomann et al. | 404/4 |
| 4,630,962 | 12/1986 | Thomann et al. | 404/2 |
| 4,630,966 | 12/1986 | Karbstein | 405/118 |
| 4,640,643 | 2/1987 | Williams | 404/4 |
| 4,699,544 | 10/1987 | Karbstein | 405/118 |
| 4,787,773 | 11/1988 | Kehler | 405/118 |
| 4,815,888 | 3/1989 | Stegmeier | 404/4 |
| 4,838,727 | 6/1989 | Capuano | 404/2 |
| 4,844,655 | 7/1989 | Aleshire | 405/118 |
| 4,904,113 | 2/1990 | Goddard et al. | 405/45 |
| 4,940,359 | 7/1990 | Van Duyn et al. | 405/118 |
| 4,968,170 | 11/1990 | Wilson et al. | 404/2 |
| 5,024,550 | 6/1991 | Mainville | 404/4 |
| 5,026,202 | 6/1991 | Thomann | 404/4 |
| 5,061,116 | 10/1991 | Monks | 405/118 X |
| 5,066,165 | 11/1991 | Wofford et al. | 405/119 |
| 5,130,016 | 7/1992 | Gavin | 210/164 |
| 5,181,793 | 1/1993 | Dekel | 404/4 |
| 5,213,438 | 5/1993 | Barenwald | 404/2 |
| 5,226,748 | 7/1993 | Barenwald et al. | 405/121 |
| 5,281,052 | 1/1994 | Beamey | 405/119 |
| 5,340,234 | 8/1994 | Rossi et al. | 405/119 X |

OTHER PUBLICATIONS

ACO Polymer Products–Drain Products catalog. (Copyright 1990, "print" date Jan. 1991) and group exhibit of miscellaneous ACO materials.

NDS (National Diversified Sales, Inc.) catalog entitled "Exterior Drainage Products", undated.

Wilkins Drainage brochure (undated and entitled "Better by Design" Wilkins Drainage—Specifications Guide and Parts Catalog).

Wilkins "Drainage, Regulators, Fittings—for the 'Do it Yourselfer'" brochure (undated).

"Drainage by Wilkins" brochure (undated).

Polydrain/ABT, Inc.'s "The Simple Solution to Surface Drainage—Design Professionals Manual" catalog (undated).

NDS Drainage Product Catalog (undated).

Reprint from Apr. 1983 Chemical Processing magazine entitled "Prefabricated Floor Drains of Acid Resistant Concrete Expedite Plant Expansion".

Reprint from Feb. 1985 Plant Services magazine entitled "Vinyl Concrete Channels Handle Acid Waste".

TRENCH DRAIN SYSTEM

Field of the Invention

This invention relates to trench drains or so-called channel drains, and more specifically, to standard-length trench drain units which can be joined end-to-end to create a trench drain system.

Background of the Invention

Trench drains are used where there is a need to drain a generally flat surface, such as a factory floor, airport apron area, roadway median, overhead or garage door opening, service station apron, driveway, and the like. Typically, known trench drains take three different forms. One form is a relatively inexpensive extruded plastic unit having no built-in pitch; such units are joined in end-to-end fashion through use of extra connector pieces to form the desired trench length. Then, either out of one or both vertical ends (or instead at some point along the extended trench drain's bottom through simple drain openings with so-called Atrium-type drain grids) one or more drainage pipes are connected to drain the non-pitched trench drain. This type of inexpensive non-pitched trench drain has several disadvantages, i.e., it does not typically drain well (as interference lips are created at the joints), it cannot withstand any significant vertical compressive forces, and it requires the use of extra connector components to create an extended trench run.

A second type of trench drain is a heavy duty type trench for heavy use conditions, and usually formed as a pre-cast polymer concrete drain unit. This type trench drain typically has a specific pitch built into each separate unit, such that extensive engineering specifications are required for manufacture, layout and installation. Typically, as many as 20 different pieces, for example, each having a separate built-in pitch, are required to create a trench drain run of a given length. Such heavy duty trench drains are difficult and labor intensive to assemble on site. Further, since each piece is necessarily different, such trench drain systems require substantial manufacturing costs, including substantial mold costs. Consequently, a pitched-type heavy duty trench drain is extremely costly to make, purchase, specify, and install.

Yet a third type trench drain comprises a poured-in-place concrete trench drain, which has the disadvantage of excessive cost, including the need for custom-made grates.

The present invention overcomes the problems of the various prior art trench drains by providing a trench drain system formed of a single, or a plurality, of standard length, non-pitched, universal trench drain units, i.e., each unit is identical to the next. The present standard drain unit is provided with respective female and male ends providing an interference-fit, tongue-and-groove connection, so as to readily provide a substantially watertight sealing engagement between successive trench units. Specially configured male and female end caps are provided, as needed, to close off a terminal end of a trench drain unit. Further, each trench drain unit can be sawn transversely, to result in a required trench drain length; when so transversely cut, the resulting cut end presents a female end capable of accepting a male end cap. Each standard unit contains, proximal its respective ends, downwardly-extending drain openings, which are covered with knock-out membranes and which open into at least one pipe connector flange. Further, the present trench drain system utilizes a buried parallel drainpipe which is purposely pitched. Such a supplemental drainpipe can be formed from readily-available, inexpensive drainpipe materials and components (as compared to the trench drain itself), such as plastic corrugated pipe, smooth-walled pipe, or the like.

The present invention differs greatly from the costly individual heavy-duty units of the prior art, where each unit was purposely formed to have a different built-in pitch. Thus, the non-pitched universal trench drain unit of the present invention eliminates the excessive manufacturing costs required with many prior art trench drain units. Further, all necessary components are molded into the present basic trench unit, and can be used, or not used, as desired.

Because of the novel construction of the present trench drain invention, it can be installed as either a one piece drain unit, or instead, several of the present standard length units can be fitted together in interlocked, end-to-end, series fashion to create a desired length run of channel drain.

A specially-configured grate member rests upon grate support ledges formed on the upper inside edges of the trench drain's respective side walls; the walls of slotted openings in the grate engage upstanding lugs formed on the ledges. Such cooperative locking engagement (of the side walls' upstanding lugs with the mating openings in the grate member) acts to prevent any unwanted lateral "spreading" of the drain's side walls, such as might occur when excessive vertical weight, i.e., compressive forces, are applied to the drain. An expanded lower section for each trench drain unit provides a large stabilizing base, as well as an additional area to be back-filled for retention purposes, such as by concrete. Preferably, the trench drain and grate members of the present invention are made from injection molded plastic.

An end cap drain member is provided for those few instances when bottom-draining of the trench drain unit is not possible, and the associated drain pipe needs to be end-drained from the trench unit's end cap.

Thus, it is a principal object of the present invention to provide an economical, standard length, universal, non-pitched trench drain unit having respective male and female ends, with grate member and terminal end caps, all being preferably formed of injection molded plastic, and connectable to an inexpensive buried drain line installed with pitch.

It is a further object of the present invention to provide an economical trench drain system which reduces the overall need for numerous costly secondary apparatus, i.e., catch basins, lift stations, clean-outs, and the like.

It is yet a further object to provide a universal trench drain unit which can be transversely cut to a desired length, such as in the field during installation, at any point along its length, which when cut still presents a female end which can readily accept a standard male end cap.

A still further object is to provide a trench drain system utilizing a supplemental buried, inexpensive drain line which need not terminate adjacent a terminal end of the surface trench drain unit.

It is a still further object to provide an inexpensive, easy-to-install trench drain unit, which is complete with all the needed draining and pipe-fitting components, for use as desired.

The means by which the foregoing and other objects of the present invention are accomplished and the manner of their accomplishment will be readily understood from the following specification upon reference to the accompanying drawings, in which.

Description of the Preferred Embodiment

Figure 1:
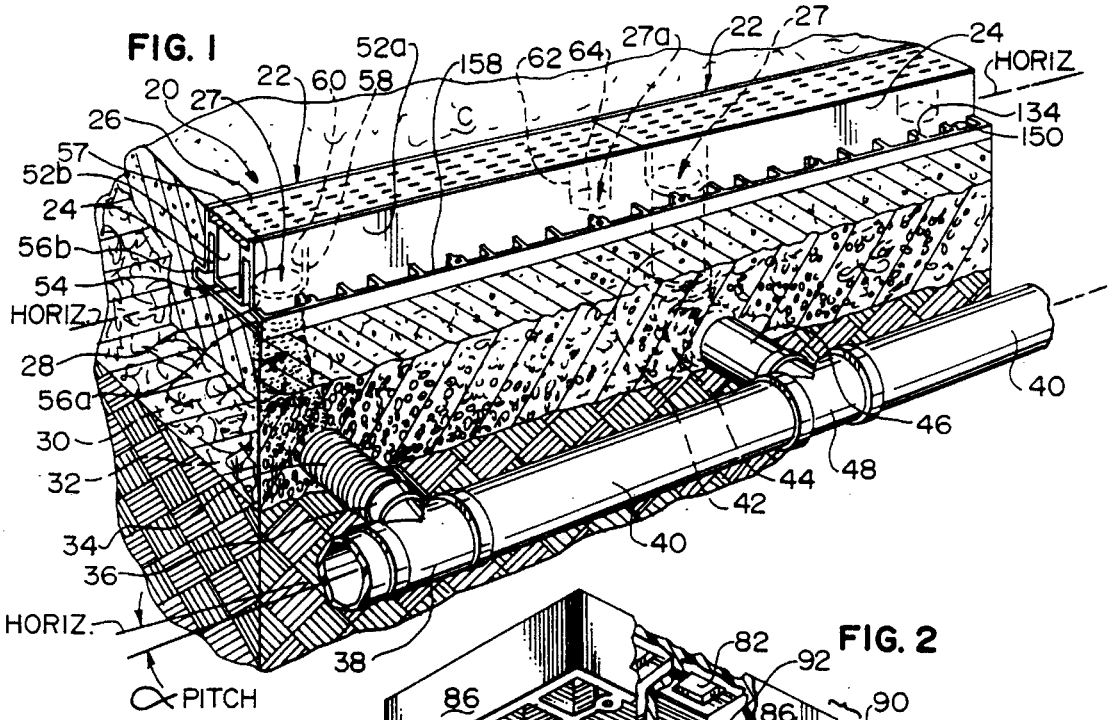
FIG. 1 is a perspective view of two connected universal trench drain units of the present invention, as installed and connected to a buried drainpipe, and depicting drainage with two alternate type of drainpipes.

Having reference to the drawings, wherein like reference numerals indicate corresponding elements, there is shown in FIG. 1 an illustration of a trench drain system, generally designated by reference numeral 20. As shown in FIG. 1, the trench drain system 20 comprises two universal, i.e., standard length and identical, trench drain units 22, each including a generally U-shaped open-topped trench drain member 24 and a covering grate member 26. The left drain unit 22 (when installed in a standard typical installation as shown in FIG. 1) has its drainage channel 50 drained through a bottom drain opening 27, via an adaptor 28 and a section of conventional corrugated (preferably non-slitted) plastic pipe 30, to a hard plastic (i.e., PVC) 90° elbow 32. It is then drained through another section of corrugated pipe 34 and another adaptor 36 to a conventional hard plastic (i.e., PVC) "T" member 38, the latter forming part of a secondary buried drain line 40. It will be understood that the drainage channels 50 of the trench drain units 22 are purposely formed with no pitch; the drain units 22 are installed so that they lie flush with the concrete surface C that they drain (see FIG. 1). However, the drain line 40 is installed at a desired slight pitch, such as ⅛th inch per running foot, for example, and is drained to a remote holding tank or other collection point (not shown).

For reference purposes only, since they form no part of the present invention, it will be understood that the adaptor units 28, 36 can be of the type shown in the applicant's prior patent application Ser. No. 913,143, filed Jul. 14, 1992, and sold by the present application's assignee under Tuf-Tite, Inc.'s part number MF4. Generally, the adaptors 28, 36 comprise a specially-configured stretchable connector device adapted to sealably connect corrugated plastic drainpipe to smooth-walled hard plastic drainpipe and to drain components such as elbows, T's, and the like. That is, one end of the adaptor 28 would stretchably fit over the open end of corrugated pipe 34, while the other end would fit into the open mouth of an elbow 32, for example.

Since FIG. 1 is not drawn to scale, it will be understood that, in a typical installation of a trench drain unit 22 such as in FIG. 1 (left end), the corrugated pipe section 30 is preferably approximately three to four inches in length, while the pipe section 34 is approximately twelve to eighteen inches in length.

The right drain unit 22 (when installed as shown in FIG. 1) is alternatively connected to the buried secondary drain line 40 via a section of smooth-walled hard plastic pipe 42 fitted to drain opening 27 of trench member 24, a 90° elbow member 44, another section of smooth-walled pipe 46, and a "T" section 48 (similar to "T" 38).

A primary advantage of the present invention is that each drain unit 22 is, in effect, a universal unit. That is, each drain unit 22 is formed identical in shape, configuration, and size to the next and without any built-in pitch, such that only one type drain unit is required whether to create either a one-unit drain, or instead a multiple-unit run of trench drain. Preferably, each of the drain member 24 and grate 26 are injection molded from a suitable high-density polyethylene material so as to be non-corrosive. In a drain member 24 made in accordance with the preferred embodiment, the length of the universal drain member is preferably 3 feet, its outer width (at the top of the U-shaped drainage channel 50) is approximately 5 inches, the inner width (at the top of channel 50) is approximately 4¼ inches, the overall outer height of drain member 24 is approximately 5⅛ inches, and the inner height dimension of drain channel 50 is approximately 3¼ inches.

Each standard drain member 24, thus, includes the drain channel 50 formed by two vertically-aligned side walls **52*a*, 52*b*, and a base section 54, the latter including two outer base extensions 56*a*, 56*b*. The extensions 56*a*, 56*b* are integrally formed with base section 54. Their purpose is to provide the trench member 24 with a wider base, and thus, to provide better support so as to stabilize the drain unit 22** once installed. As explained later herein, such installation is typically by being backfilled and set in concrete, flush to the floor.

Figure 2:
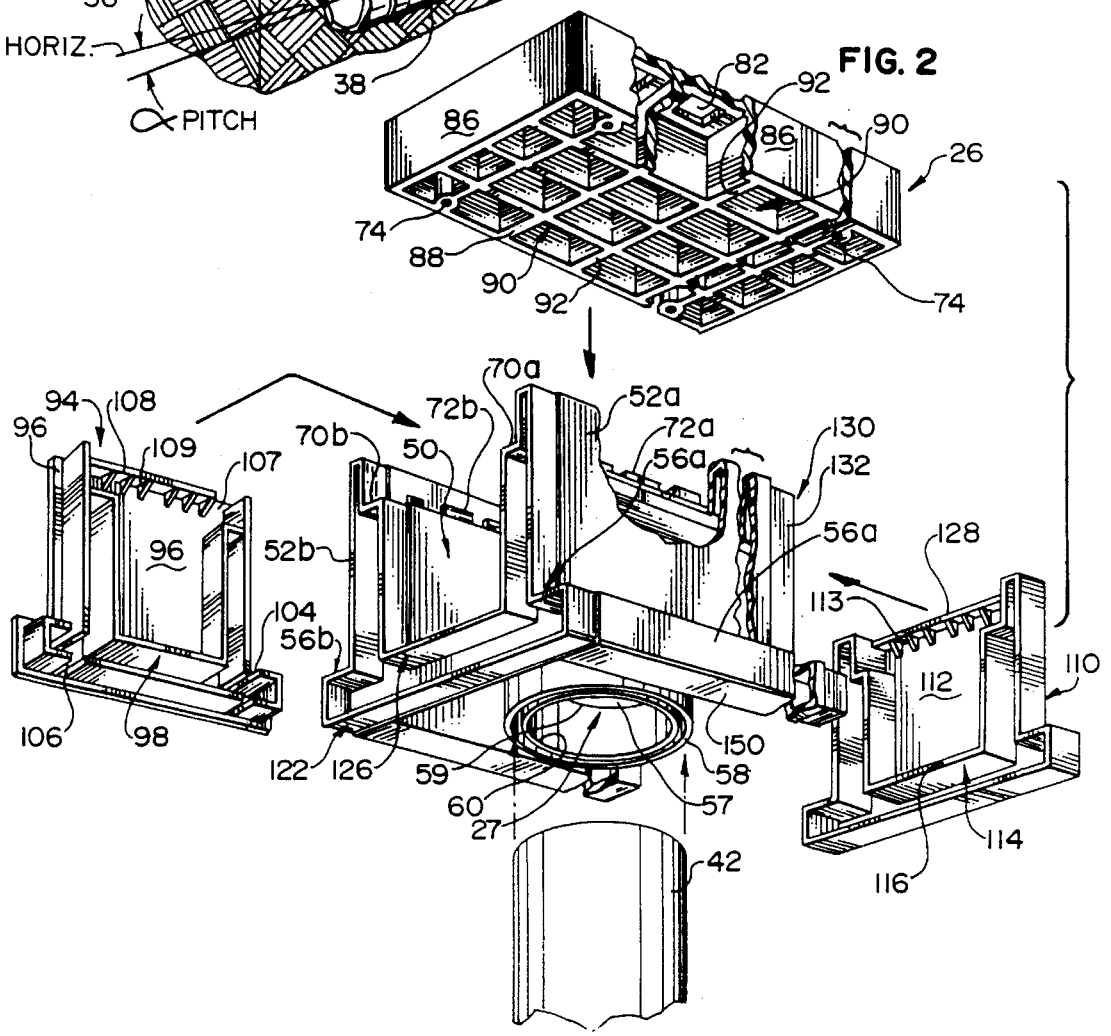
FIG. 2 is a perspective exploded assembly view of a trench drain unit of FIG. 1.

Preferably, each drain member 24 also includes at least two differently-sized bottom drain openings, which together can accommodate at least three differently-sized, commercially available drainpipes. More specifically, as best seen in FIG. 2, towards the left end of left trench drain unit 22 ("left" per FIG. 1), are two concentric, downwardly-extending pipe connector flanges 58 and 60. Each such pipe connector flange is purposely sized to accommodate a given size of drain line. For example, if a 4" drainpipe is to be used to drain the bottom of a drain unit 22, then a thin knock-out membrane 57 having a weakened line 59 (see FIG. 3) is removed from the base of channel 50; appropriately placed blows of a hammer, or cutting with a knife, can be used to sever line 59 and remove the knock-out member 57. This results in a drain opening 27 which is surrounded by both the concentric pipe connector flanges 58, 60. Thereafter, as depicted in FIGS. 2 and 4, a 4 inch smooth walled pipe section 42 can be friction-fitted to the inner diameter of the outer flange 58. In the preferred embodiment, the inner diameter of flange 58 is approximately 4.20 inches; it is able to accommodate, i.e., be frictionally engaged with, the end of a standard 4 inch smooth-walled plastic pipe, such as either the commonly available type known as ASTM 2729 pipe (also called thin-walled pipe or 1500 lb. crush pipe), or with the 4 inch pipe known as SDR 35 pipe (also called 3034 pipe). Additionally, the male end of an adaptor, such as adaptor 28, can be fitted to the inner diameter of flange 58, and then a corrugated pipe (such as 4" corrugated flexible polyetheylene tubing), i.e., like pipe 30, can be fitted to the adaptor 28. The preferred thickness of the material creating the weakened line 59 is approximately 0.020 inch.

Alternatively, a smaller diameter drain pipe may be used to bottom drain the trench drain unit 22, such as a commonly available 3 inch line. The knock-out member 57 is first removed, again resulting in the same sized drain opening 27. However, in this case, a smaller diameter drain pipe, such as a 3 inch drainpipe (shown in phantom by reference numeral 61 in FIG. 4), is friction-fitted to the smaller diameter connector flange 60. In the preferred embodiment, the inner diameter of connector flange 60 is approximately 3.5 inches. Accordingly, that connector flange 60 is able to accommodate (via a friction fit) the end of the common 3 inch smooth-walled drain line, such as the so-called 3 inch Schedule 40 pipe.

Figure 5:
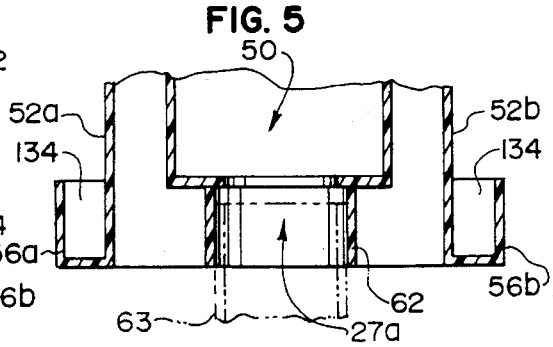
FIG. 5 is a partial vertical cross section of the trench drain unit of FIG. 3, taken at lines 4—5 and depicting where another drain opening is located.
Figure 6:
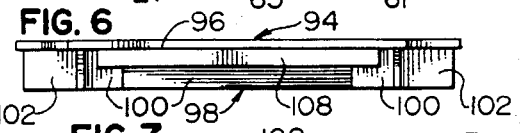
FIG. 6 is a top plan view of the left, i.e., male, end cap of FIG. 2.

The other remaining or small pipe connector flange 62 can be used if yet a smaller drain line is to be used. The flange 62 is located at the opposite end of each standard drain unit 22 (see right end of the left drain unit 22 as depicted in FIG. 1). In that case, a smaller diameter knock out membrane 64 is removed, which results in a small drain opening 27*a* which, in turn, communicates with the small pipe connector flange 62. In the preferred embodiment, the inner diameter of flange 62 is approximately 2.4 inches; it will accept, again by direct friction fit (i.e., without the need for any special adaptor connector), the end of a commonly available drain line 63 (shown in phantom in FIG. 5), such as that type commonly known as the 2 inch Schedule 40 pipe.

To assure a completely water-tight fit (over and beyond the friction fit available with the pipe connector flanges of the present invention) of any type of drain pipe to a given pipe connector flange 58, 60, or 62, it will be understood that a suitable silicone sealant or other sealing and caulking compound can be used. Further yet, where a corrugated pipe is to be used for the bottom-drain line, an adaptor (such as that described as adaptors 28, 36 above) can be used.

If desired, a separate perforated strainer plug member 65 (see FIG. 4) may be fitted in the drain opening 27, once knock-out member 57 has been removed, so as to catch any unwanted debris in drain channel 50 from entering the associated drainpipe.

Figure 3:
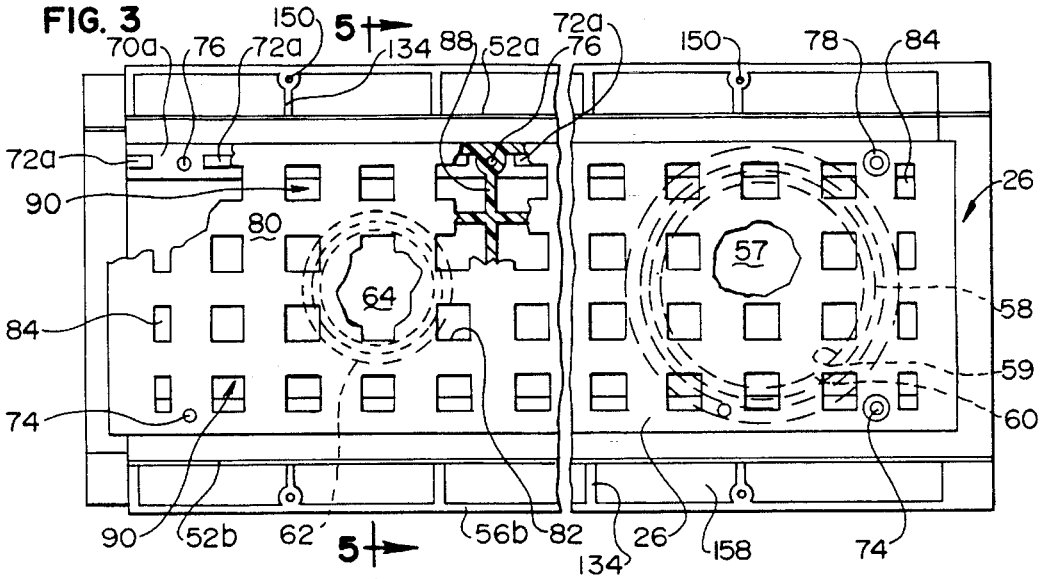
FIG. 3 is a plan view of a trench drain and grate of FIG. 1, and depicting various structural details in phantom or section.
Figure 4:
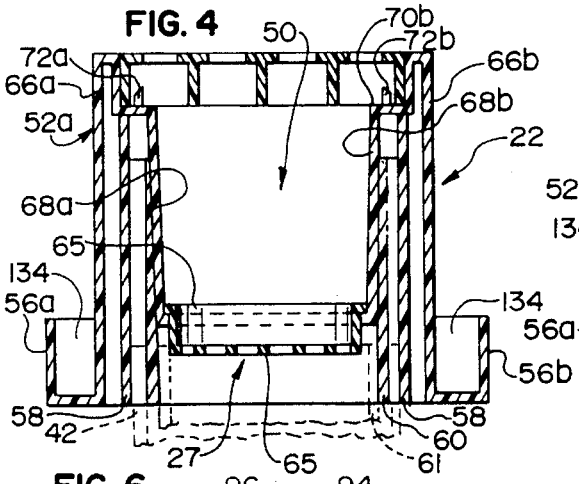
FIG. 4 is a vertical cross section of the trench drain unit of FIG. 3, taken at lines 4—4 and depicting where one drain opening is located.

FIG. 4 shows a transverse cross section of a typical trench drain unit 22, as taken along lines 4—4 of FIG. 3. As will be seen, that transverse cross section dissects through the major diameter of the concentric pipe connector flanges 58, 60, such that the internal wall structure for the trench drain member 24 at that location is fully shown. More specifically, the trench drain member 24 includes both the vertical side walls 52*a* and 52*b*. They respectively include outer wall members 66*a*, 66*b*, inner wall members 68*a*, 68*b* (which form part of the U-shaped drain channel 50), and configured upper ledge sections 70*a*, 70*b* formed therebetween. The lower portions of outer side walls 52*a*, 52*b* respectively terminate in the lower outer base extensions 56*a*, 56*b*. Also, as seen in FIG. 4, at this particular location the circular pipe connector flange 58 has walls which extend upwardly to terminate integrally into the lower portion of the respective grate support ledge sections 70*a*, 70*b*. Similarly, the upper reaches of the circular-shaped but smaller pipe connector flange 60 are integrally formed with and die into the respective inner side walls 68*a*, 68*b* of channel 50.

As best seen in FIGS. 2, 3, and 4, the horizontal portions of the grate support ledge sections 70*a*, 70*b* have formed thereon respective aligned series of upstanding, separated lug members, generally designated by reference numbers 72*a*, 72*b*. The grate member 26 spans across the channel side walls 52*a*, 52*b* and is supported on the respective ledge sections 70*a*, 70*b*. Grate 26 has a plurality of chamferred through holes 74 corresponding to a matching series of fastener holes 76 formed on the horizontal portions of the ledge sections 70*a*, 70*b* (see FIG,. 3). Each of the holes 74 accepts an appropriate fastener 78, such as a stainless steel 10 Type A-SmS screw, for example. Through use of fasteners 78, the grate 26 can be securely maintained in its correct position relative to the trench drain member 24. However, as needed it can be readily removed to permit clean-out or other maintenance service of its associated drain member 24. Also, preferably, the patterns for the respective series of holes 74, 76 are so formed that the grate 26 can only fit the length of one drain member 24 in one way, such that the grate cannot be made to fit equally across and span, for example, the ends of two abutting drain units 24.

The grate 26 is formed as an extended panel member having an upper grate surface 80 formed with aligned series of equal-sized square grate openings 82. Preferably, the grate 26 is injection molded, of high density polyethylene, and without use of any foams or fillers like done with many prior art grates, such that the grate 26 is quite strong. At the outer respective ends of grate 26 are formed half-sized, i.e., preferably rectangular-shaped, grate openings 84. Extending downwardly from the periphery of grate surface 80 is a continuous side wall 86. As best seen in FIG. 2, the underneath side of grate 26 comprises an integrally formed grid 88 which extends the full height of the peripheral side wall 86. Each separate grid section 90 surrounds, and is slightly larger in dimension than, its respective grid opening 82.

The outermost grid sections 90 (see FIGS. 2–4) of grate 26 are purposely so dimensioned that the respective transversely-aligned grid walls 92 lie in the separations formed between the individual lugs 72*a*, 72*b* of supporting ledge sections 70*a*, 70*b*. Thus, the lateral grate side walls 86, as well as the outer transverse grid walls 92, sit directly upon the respective upper ledge sections 70*a*, 70*b*. This assures that any tendency for expansion, i.e., lateral spreading, between the vertical side walls 52*a*, 52*b* of the trench drain member 24, such as might occur due to excessive vertical forces applied to the grate member 26, is rigidly resisted by the cooperative locking engagement of the upstanding lugs 72*a*, 72*b* with grate side walls 86. Stated another way, the interlocking engagement of the upstanding lugs 72*a*, 72*b* with the longitudinal side walls 86 allows the grate member 26, once fastened via fasteners 78 to drain member 24, to securely retain and prevent any lateral outward deflection of the vertical side walls 52*a*, 52*b*. Hence, the universal trench drain unit 22 of the present invention provides substantial structural rigidity. It can withstand heavy vertical loads, such as by vehicle traffic, lift truck tires, and the like. In one test of a trench drain unit 22 made in accordance with the present invention, and tested without being encased in concrete, it was found to withstand (before deformation) vertical test forces in the range of approximately 200 pounds per square inch as applied directly to the grate member 26. Thus, a trench drain unit made in accordance with the present invention, and when encased in concrete or other flooring material, is believed to be of sufficient strength and rigidity to withstand heavy commercial and industrial use, such as found with forklift trucks and other heavy vehicular traffic.

As seen in FIGS. 2, 6, 7, and 10, a snap-on male end cap 94 is provided to terminate, i.e., sealably close off, the left or female end 122 of the trench drain member 24 (see FIG. 2). The male end cap 94 comprises an outer end wall 96 as well as an inwardly projecting series of tongue walls 98. The tongue walls 98 (see FIG. 7) are integrally formed with end wall 96 but are displaced slightly inwardly of the outer peripheral edge thereof. The tongue walls 98 include a configured, generally U-shaped upper tongue member 100, as well as a lower, generally C-shaped base tongue member 102. The U-shaped tongue 100 is separated from the C-shaped base tongue 102 by a pair of slots 104, while the lower portion of base tongue 102 is interrupted by a pair of slots 106. Further (see FIGS. 6 and 7), a horizontally-aligned top wall member 108 extends inwardly from the end wall 96, but to a lesser distance than the tongue walls 98. A pair of slots 107 separate the upper tongue walls 100 from the top wall 108, and a series of triangular-shaped, integral gussets 109 support top wall 108 against end wall 96. The tongue walls 98, in the preferred embodiment, extend to a length of approximately 0.625 inch.

Figure 8:
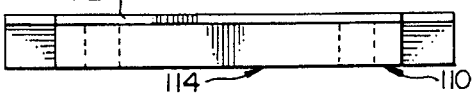
FIG. 8 is a top plan view of the right, i.e., female, end cap of FIG. 2.
Figure 9:
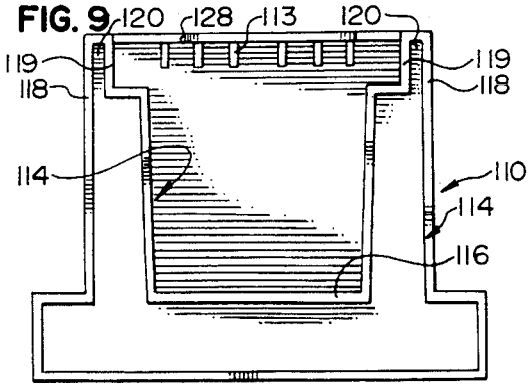
FIG. 9 is a side elevation of the inner face of the female end cap of FIG. 2.

A snap-on female end cap 110, as shown in FIGS. 2, 8, and 9, is used to sealably terminate the male or right end 130 of trench member 22 (see FIG. 2). The female end cap 110 includes an end wall 112 and a configured, inwardly extending series of female groove walls 114. The groove walls 114 (see FIG. 9) extend inwardly (towards drain member 24) from the end wall 112, are integrally formed therewith, and are formed about the outer peripheral edge of end wall 112. The groove walls 114, in the preferred embodiment, also extend to a length of approximately 0.625 inch. The female groove walls 114 are integrally formed into a continuous member having no slots (unlike the presence of slots 104, 106, and 107 of the male end cap 94). The upper portion of female groove walls 114 form a generally U-shaped groove wall 116, the upper respective regions of which include walls 118, 119 which are separated so as to form cavity areas 120 therebetween. Further, a horizontal top wall 128 (similar to top wall 108 of male end cap 94) is integrally formed at the upper horizontal edge of female end wall 112, and is supported thereagainst by a series of integrally-formed gussets 113. However, top wall 128 extends inwardly only approximately half the distance as does the remainder of female groove walls 114.

Figure 7:
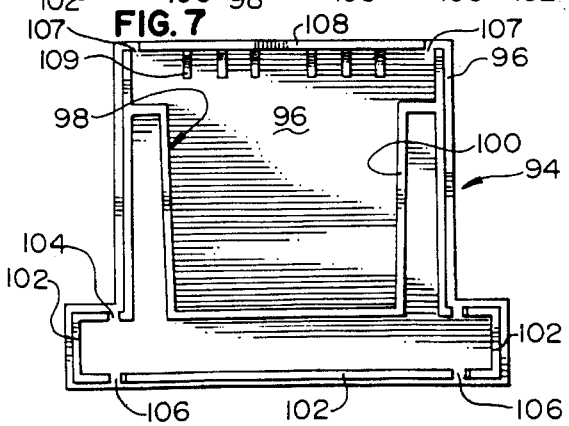
FIG. 7 is a side elevation view of the inner face of the male end cap of FIG. 2.

Thus, by comparing the male end cap 94 of FIG. 7 with the female end cap 110 of FIG. 9, it is seen that the male tongue walls 98 are so configured, and of such an extended length, but of such a slightly reduced size, as to be readily intergageable (via a tight interference fit) with the extended length of the receiving female groove walls 114. Because of their cooperating configurations then, the end caps 94, 110 can be readily snap-fitted to the ends of the trench drain member 24, so as to be encapsulated therewith. (In the preferred embodiment, the snap-on male and female end caps 94, 110 are preferably formed of a suitable non-corrosive, injection moldable plastic material, such as high density polyethylene, for example. )

The left or female end 122 of trench drain member 24 (per FIG. 2), similar to the female groove walls 114 of female end cap 110, presents a female groove end 126. That is, the female groove end 126 of trench member 24 extends longitudinally outwardly thereof and is capable of receiving, in a snap-on, encapsulating, interlocking, tongue-and-groove interference fit manner, the male tongue walls 98 of male end cap 96. As seen in FIGS. 2 and 7, the slots 104, 106, and 107 permit the female groove end 126 to accept and be tightly engaged with, i.e., sealably encapsulate, the inwardly-extending male tongue walls 98 of male end cap 94. Importantly, the female groove end 126 presents the same configuration, dimension and extension length as is presented by the inwardly extending female groove walls 114 of female end cap 110.

Similarly, the right or male end 130 of trench drain member 24 (per FIG. 2) presents a male tongue extension end 132, which also is of the same configuration, dimension and extension and length as the male tongue walls 98 of male end cap 94. Accordingly, the female end cap 110 (shown at the right end of FIG. 2), via its female extension groove walls 114, is able to be readily tightly engaged with, i.e., sealably encapsulate, the male molded tongue end 132 in an interlocking fashion.

Importantly, the encapsulated engagement of the male end 130 of one drain member 24 with the female end 122 of another drain member 24 (in a trench drain series application, such as shown in FIG. 1) is such that a substantially watertight seal is created therebetween. Further, due to the length of the mating tongue ends, that encapsulated engagement (i.e., between drain ends 122, 130) will retain its watertight capability, even when one drain member 24 is cocked and vertically misaligned vis-a-vis its adjacent drain member 24, such as by settling of backfill and the like. The use of a suitable sealant (such as a silicone sealant caulk) on encapsulated ends 122, 130 only further assures a watertight engagement.

As will be noted (see FIG. 3), the grate member 26 preferably stops short of each end of the trench member 24. This is done to permit full insertion of the respective top walls 108, 128 of the respective end caps 94, 110. Further, it will be understood that one end of grate 26, when properly installed on grate support ledges **70*a*, 70*b*, is preferably positioned so as to extend slightly (i.e., preferably approximately 0.250 inch) more towards the male end 130 of that drain member 24. This is so that particular end of grate 26 will extend onto (and be partially supported by) the separate support ledges 70*a*, 70*b*, of the female end 122 of the adjacent drain member 24**.

It will be understood that the reduced section line 124 (see left end of drain member 24 in FIG. 2) has no significance relative to the present invention; it is present only on the preferred embodiment due to the specific type of plastic injection molds used to create the actual trench drain member 24.

As seen, then, the trench drain member 24 of the present invention is formed as a standard length universal unit, with no internal pitch to the drain channel 50, and is formed at one end with a male end 130 and the other end with a female end 122. Those ends are able to accommodate (in snap-on fashion) and be sealably engaged with, i.e., terminated by, either respective female and male end caps 94, 110, or instead, be encapsulated and interlocked with the respective female and male ends of the next adjacent trench unit 22. Further, unlike the known prior art configurations, the mating tongue and groove ends of two adjoining and connected trench members 24 are so configured as to create no unwanted lips or other protrusions extending upwardly into drain channel 50. Thus, with the present invention, a given continuous run of connected trench drain units 22 has a totally smooth, uninterrupted drain channel 50. This acts to facilitate complete drainage of drain channel 50 to the secondary drain line 40. This virtually seamless fit eliminates any unwanted built-in locations for debris or drained liquid to accumulate, contrary to many of the prior art trench drains.

Figure 10:
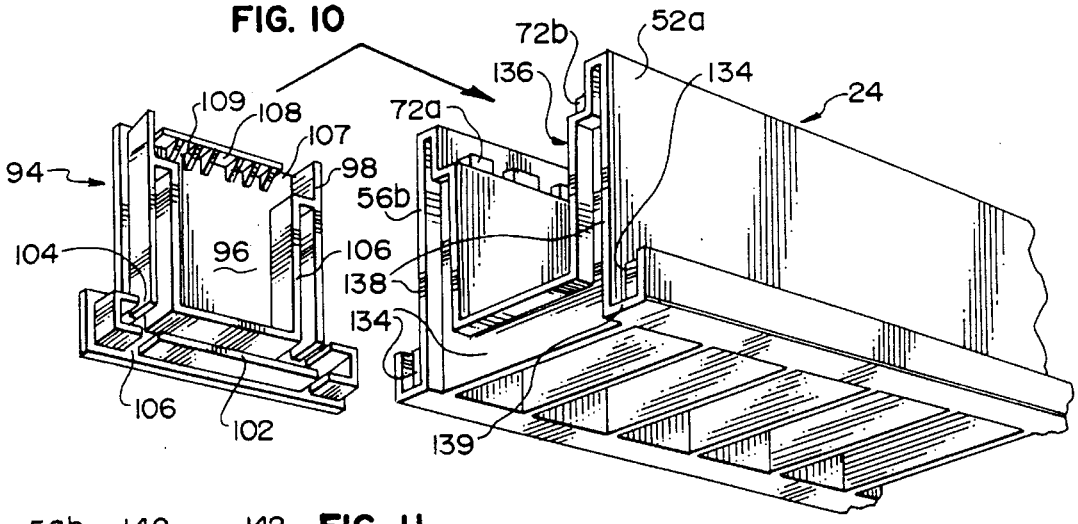
FIG. 10 is another exploded perspective view, similar to FIG. 2, but of a "field-cut" central section of a trench drain unit of FIG. 1, and depicting the manner of assembly of a male end cap.

In FIG. 10 there is seen a trench drain member 24 which has been transversely cut (i.e., see its left end) at approximately the midpoint between respective pairs of vertical inner stabilizing ribs 134. This results in a terminal or cut end 136 for that trench member 24. (As seen in FIGS. 1, 3, 4, 5, and 10, the vertical stabilizer ribs 134 also extend upwardly to approximately the same height as the side walls of outer base extensions 56*a*, 56*b*. The purpose of the rib walls 134 is to provide yet additional vertical compression strength to the drain member 24.) In any event, regardless where it is transversely cut along its length, the trench drain member 24 still presents a cut end 136 having a female end configuration that is similar to the standard female end 122 (see left end of trench member 24 in FIG. 2) and to the female groove walls 114 (of female end 110 in FIG. 2). The only difference is that the lower reaches of side wall 52*a*, 52*b* of cut end 136 extend to the bottom edges 139 of base extensions 56*a*, 56*b*. Once a trench drain member 24 has been transversely cut to create a female cut end 136, a standard male end cap 94 having slots 104 and 106 (see FIGS. 8 and 10) can be readily snap-fitted thereto to sealably terminate the shortened, i.e., transversely cut, trench drain member 24 at that desired point.

Preferably, any transverse cutting of a trench drain member 24 is done along the central area between any respective pair of vertical stabilizer ribs 134. This will assure that there is sufficient remaining longitudinal length of the resulting female groove walls 138, once a cut end 136 is created, to allow insertion and full snap-fit engagement with, i.e., encapsulation of, the male end cap's tongue walls 98. Thus, regardless of where a given run of trench drain system 20 in the field is to be terminated, the final trench drain unit 22 is capable of having its trench drain member 24 so transversely cut anywhere along its length as to result in a cut end 136 that can be terminated by a standard male end cap 94. It will be understood that the end cap 94 not only acts to keep the upper walls 52*a*, 52*b* of trench member 24 at the correct width (i.e., prevents lateral spreading adjacent the cut end 136) so as to assure properly fit with the grate 26, but also helps to strengthen (i.e., adds vertical compressive strength) the female cut end 136 (and to any standard female end 122 for that matter).

Figure 11:
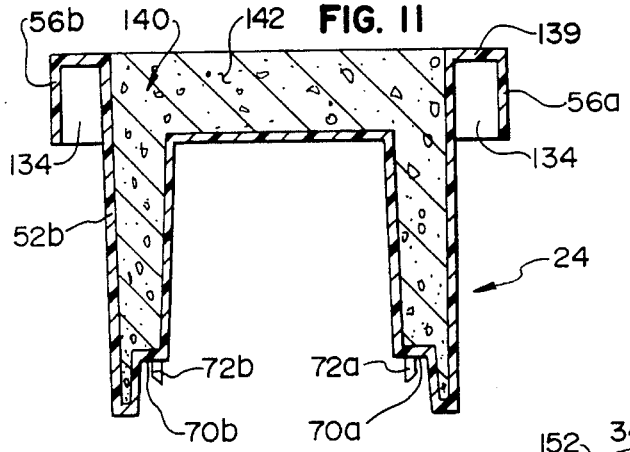
FIG. 11 is an inverted transverse cross section of a trench drain unit of FIG. 1, depicting its bottom cavity as filled with concrete.

FIG. 11 depicts how a trench drain member 34 of the present invention can be further strengthened, if ever needed for certain heavy duty end use applications, such as where heavy excessive vertical forces are anticipated. This can occur where the drain unit 22 is installed in areas with heavy lift truck usage, in assembly plants, or the presence of heavy vehicular traffic. FIG. 11 shows a transverse cross sectional view of a standard trench drain member 24 which has had its inner cavity area 140 completely filled with a suitable strengthening material. This material can be poured concrete, for example, or a synthetic resin-filled material, and is generally depicted by reference numeral 142. When such strengthening is needed, each trench drain member 24 is horizontally placed in an inverted position, and its inner cavity 140 completely filled with the concrete material 142. The strengthening material 142 is then levelled off against the inverted bottom edges 139 of the base extensions 56*a*, 56*b*. Care must be taken not to have any concrete 142 enter into, i.e., fill up, the respective pipe connector flanges 58, 60, and 62. Once the concrete material 142 has hardened, the strenghtened trench drain member 24 can be turned over to be used in its correct upright position, but now with a further enhanced compressive strength capability in its respective side walls 52*a*, 57*b* (besides that provided by stabilizer ribs 134).

Figure 12:
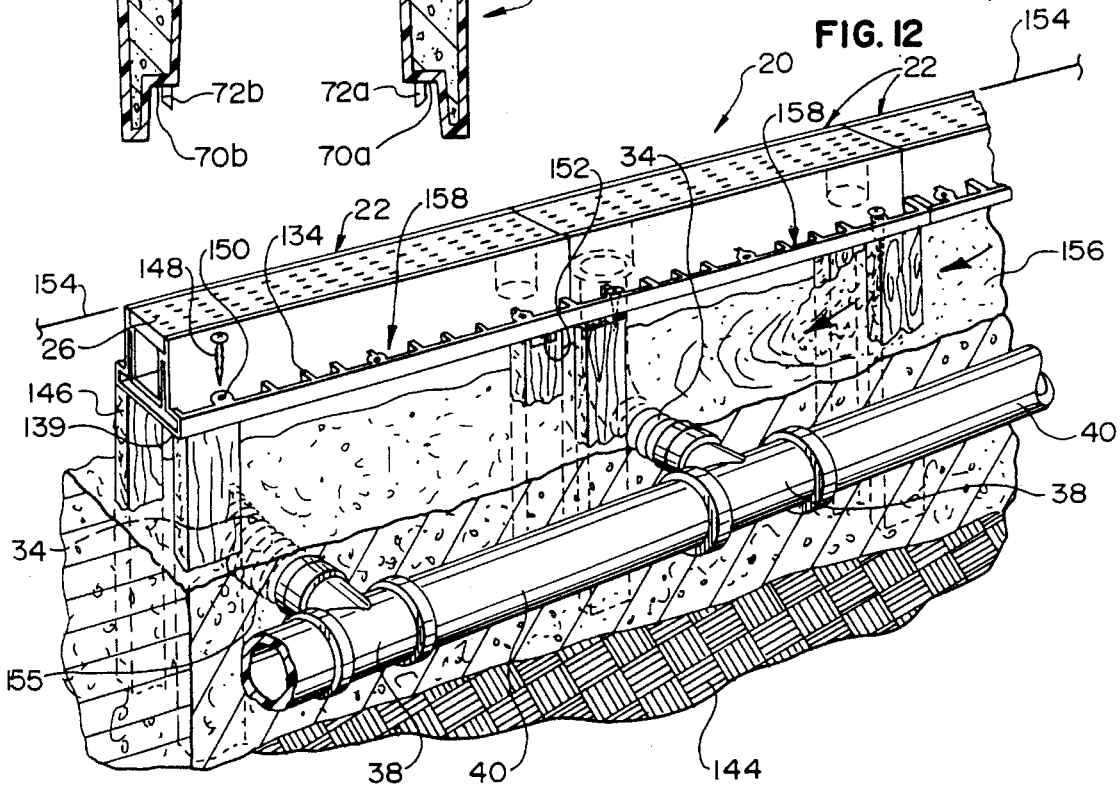
FIG. 12 is a perspective view, similar to FIG. 1, but of two trench drain sections during installation before back filling.

FIG. 12 depicts one method of installation of the trench drain system 20 of the present invention. Here, a series of three end-to-end connected, i.e., snap-fitted, trench drain units 22 are installed in an elevated manner above the subsoil 144. Nails 148 are driven through the nail openings 150 (formed in the base walls 137 of base extension members 56*a*, 56*b* ) into suitably spaced, support stakes 146 (see FIG. 12). Further, if needed, suitably tapered wooden shim members 152 can be placed atop the respective stakes 146 and under the lower base wall 139 (of base extensions 56*a*, 56*b* ); the shims 152 are used to raise the trench drain unit 22 so that the upper surface 80 of grate member 26 is correctly aligned with a tautly-stretched installation guideline (depicted by reference numeral 154 in FIG. 12).

During one type of installation of trench drain system 20, it will be understood that the buried drain line 40, and associated T components 38 and sections of corrugated drainpipe 34, are first installed into the subsoil 144 with drain line 40 placed at the correct pitch. Thereafter, stakes 146 are driven into place. Then, each trench drain unit 22 is set atop the stakes 146, and shimmed as needed via tapered shims 152, until the top of the trench drain unit 22, i.e., via surface 80 of grate 26, is level with the stretched guideline 154. Then, successive trench drain units 22 are connected, via tongue-in-groove snap-fitting, to the respective ends of the initial trench drain unit 22, until the desired trench length is complete. Then respective male and female end caps 94, 110 are snap-fitted to the outer respective units 22. Then the selected ones of drain openings are connected by suitable drainpipes to the buried line 40. Thereafter, a suitable backfill material, such as compactible granular fill 155 (such as sand, as depicted in FIG. 12) is placed over the subsoil 144 to establish a suitable subgrade. Then, concrete 156 is poured over the subgrade to completely fill underneath and about the sides of the trench drain units 22 until flush with grate cover 26. The concrete 156 is caused to flow over and into the respective pockets 158 (formed in the respective base extensions 56*a*, 56*b* between respective vertical stabilizer ribs 134); this helps to further stabilize and backfill the trench units 22 within the concrete 156, once hardened. Although concrete 156 is a preferred back-fill material, asphalt, sand, gravel or even dirt could instead be used.

Figure 13:
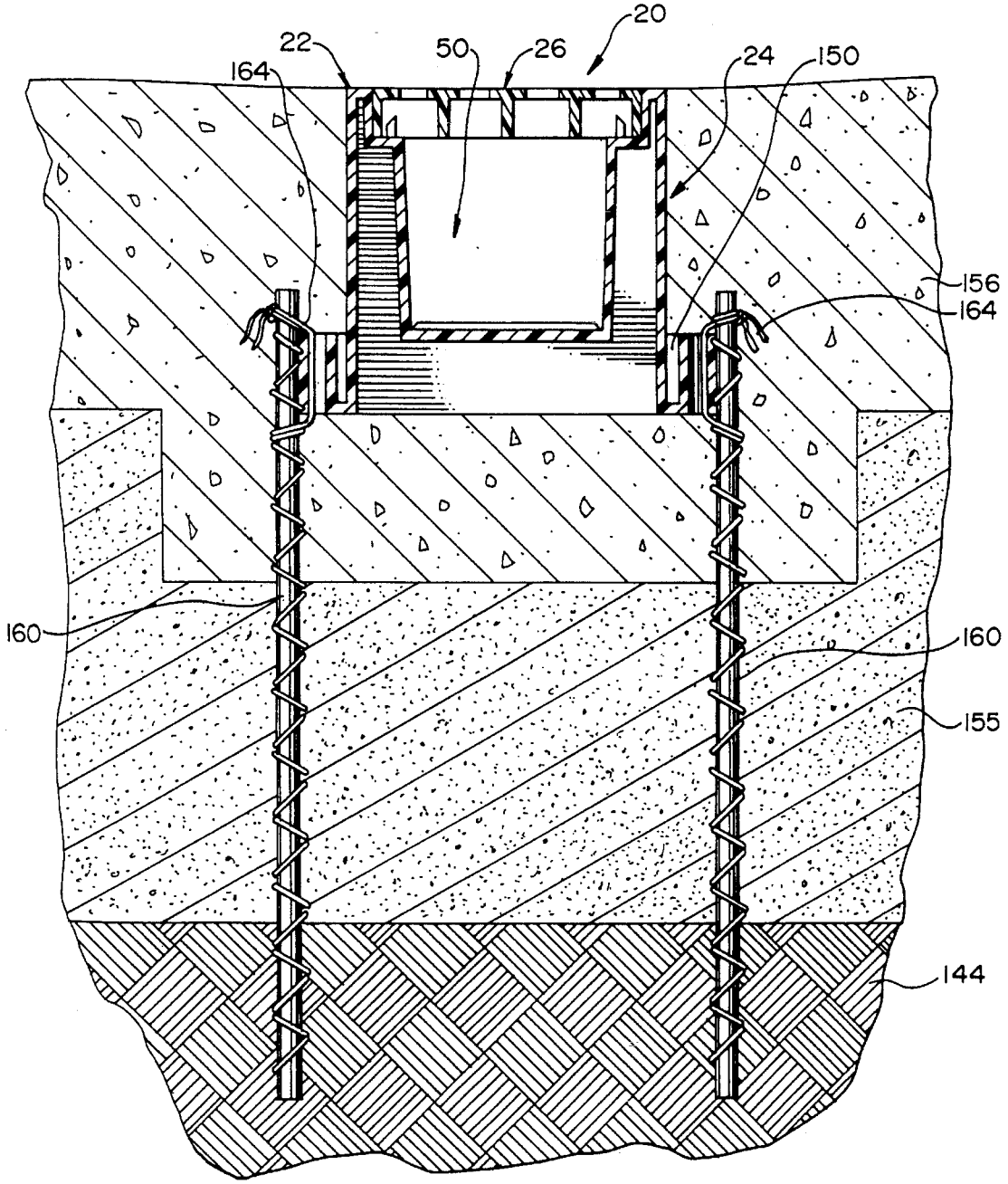
FIG. 13 is a vertical view depicting an alternate installation method for the present trench drain unit.

FIG. 13 shows yet an alternative method of installing a trench drain system 20, particularly one where the engineering specifications for a given job are such that no buried wooden stakes 146 are permitted. Here, an installation support system of steel reinforcement bars is erected, as formed of vertical bars 160. The rod 160 to be used is preferably ½ inch (or ⅝ inch) in diameter.

As seen in FIG. 13, a suitable wire tie 164 is inserted up through the nail hole 150 (of the trench drain's base extensions 56*a*, 56*b* ) and then bent over and tied off to the vertical rod 160. Care is again taken, when adjusting the wire tie 164, to correctly align the upper grate surface 80 level with the stretched guideline 154. Yet even further methods of installation of trench drain units 24 can be used without departing from the unique advantages obtained from the universal trench drain system of the present invention.

In use, the present trench drain system 20 can be so installed that every trench drain unit 22 is bottom-drained to the secondary drain line 40, or instead every other trench drain unit 22 is so drained, or every fifth one, and so forth, depending upon the application. That is, since the end-to-end connected trench drain units 22 are installed flush with the concrete surface C (see FIG. 1), and each trench drain member 24 has no built-in pitch, drainage only need occur at those sufficiently spaced locations which still allow proper drainage of the overall trench drain system 20.

Moreover, because a supplemental buried drainpipe 40 is utilized, that pipe can be formed of inexpensive materials, drained at any pitch as desired, and drained underground to any remote location as desired. For example, there is no requirement that the secondary drain line 40 terminate in a location near a terminal end of the trench drain system 20. Instead, for example, it could drain only one drain opening 27, such as from a centrally-positioned trench drain unit 22, and then run perpendicularly away from the run of trench drain system 20, to a remote drain location. Further, as needed, secondary drain components, such as clean-outs, lift stations, catch basins, and other drainage-related secondary components can be used. However, the need for them is kept to a minimum because the primary drainage channel, i.e., channel 50 of each trench drain unit 22, is purposely not pitched. Instead, it is only the secondary drainline 40 that carries any required drainage pitch. It will be understood that the secondary drainline 40 of the present invention can be drained into a collector box, a sewer, a sanitary drain, a catch basin, a lift station, a clean-out, or the like (none being shown).

Further, because the trench drain unit 22 of the present invention places its required drainage pitch into an inexpensive secondary buried drainline 40, rather than into the injection-molded trench drain member 24 itself, only one size of standard length, non-pitched trench drain member 24 need be utilized. Thus, for installation purposes, only one type standard length trench unit need be purchased, stocked and used, in connected multiples where required, rather than a consecutive series of differently-pitched separate units, as is required with prior art trench drains.

Yet a further advantage of the present invention is the fact as normally installed, that the secondary drain line 40 is buried to a substantial distance, i.e., preferably one foot or more, for example, under the surface of the concrete C. Thus, contrary to certain prior art drainlines, which often were end-drained high out of the vertical end of a prior art trench unit, and therefore had only a few inches of cover of concrete, the present invention's deeply-located, bottom draining drainline will not result in any unwanted cracks in the concrete surface C. Further yet, because the present invention has at least three built-in drain connector flanges, no extra parts, i.e., expensive extra components, are required to permit hook-up to a drain line; this is contrary to the extra drain connection components as required with prior art trench drains. Thus, the universal trench drain unit 22 of the present invention for standard installations includes and requires only the trench member 24, the grate 26, and two terminal end caps 94, 110. These all can be conveniently packaged and sold as one unit.

Figure 14:
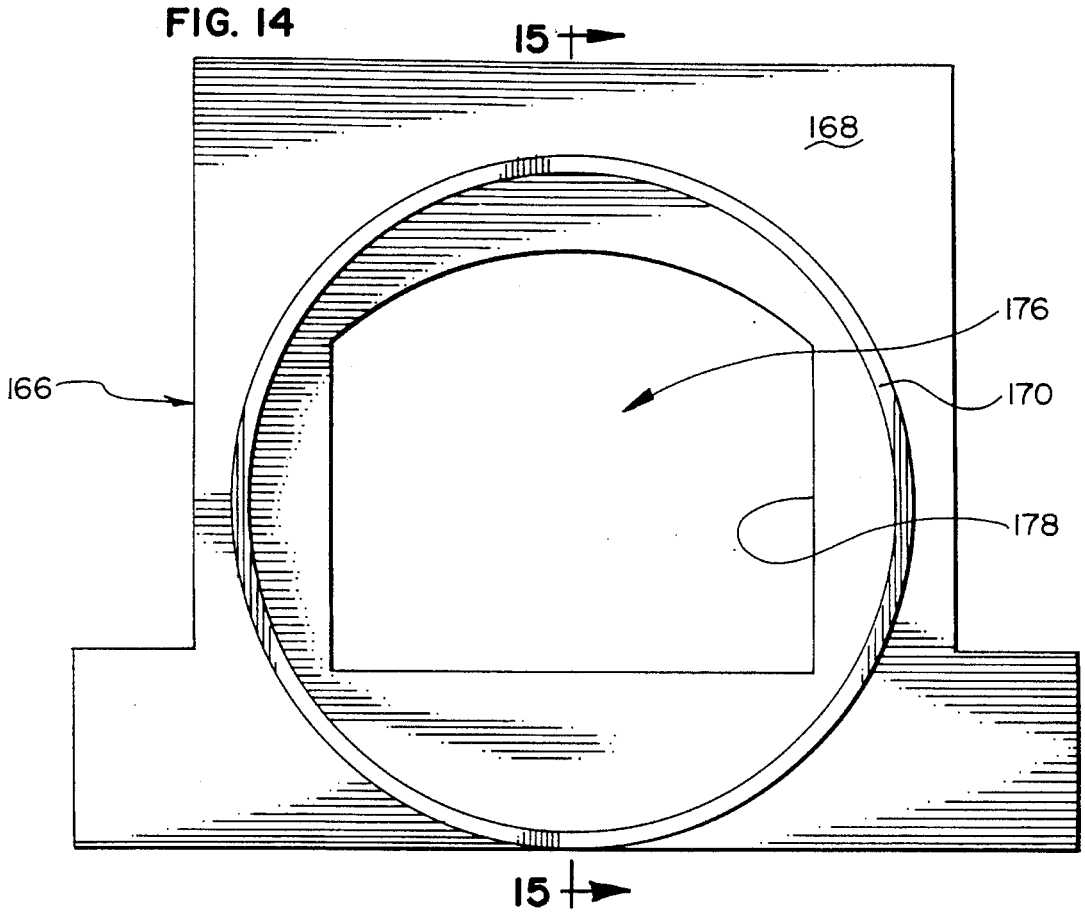
FIG. 14 is a front elevation view of a modified male end cap used for end-draining of the trench drain.
Figure 15:
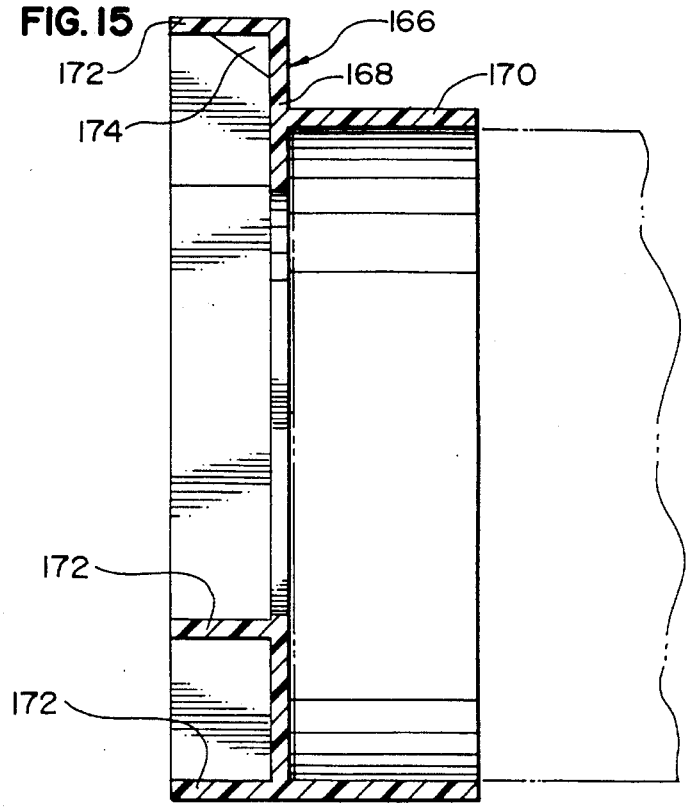
FIG. 15 is a sectional view of the modified male end cap of FIG. 14, viewed along lines 15—15 thereof.

However, there are certain installation applications where because of minimal vertical installation height available, particularly since there is the required pitch for the separate buried drainline 40, bottom-draining of the trench unit 22 is not possible. Thus, for those limited installation situations, there is shown in FIGS. 14 and 15 a male end cap drain, generally denoted by reference numeral 166. Constructed similarly to the standard male end cap 94, the end cap drain 166 includes an end wall 168, a series of inwardly-extending male tongue walls 172, support gussets 174, and also a circular pipe-receiving flange 170 extending externally of wall 168.

As best seen in FIG. 14, a drain opening 176 is formed in end wall 168 by a dome-shaped generally rectangular aperture 178, the bottom and side walls of which generally follow the profile of drain channel 50 of the associated trench unit 22, while the uppermost dome portion of aperture 178 lies below the level of the associated grate 26. It will be noted (see FIG. 15) that the bottom of pipe connector flange 170 is tangent with the bottom of drain end wall 168. Further, the dome-shaped aperture 178 is so positioned within end wall 168 that each corner of aperture 178 is removed inwardly of the inner diameter of connector flange 170. This is important because when the end of a drainpipe (shown in phantom in FIG. 115) is engaged to the inner diameter of connector flange 170, the pipe end bottoms against i.e., directly abuts throughout its entire circumference, a continuous portion of end wall 168. Also, note that no knock-out member is present to cover off the drain opening 176. In the preferred embodiment, the inner diameter of connector flange 170 is 4.20 inches. This allows the pipe connector flange 170 to sealably receive and be friction fit to most of the commonly available smooth-walled four inch plastic drain pipes. If needed, a suitable silicone sealant caulk can be used to seal the pipe end when inserted into pipe connector flange 170.

The male tongue walls 172, similar to tongues 98 of male end cap 94, provide the same encapsulating fit to the female end 122 of a trench drain unit 22, all so as to sealably close the same. However, in those applications where a unit cannot be bottom-drained via any of pipe connector flanges 58, 60, or 62, due to lack of available vertical space, for example, then male end cap drain 166 can be substituted for the standard male end cap 94. This then allows a series of trench drain units, through a terminal trench unit 22, to be readily end-drained out the side of the male end cap drain 166.

Male end cap drain 166 is advantageous in that it allows fluid flow from drain channel 50 of the associated trench drain unit 22 to flow freely into the associated drain pipe (as connected to the inner diameter of the end drain's pipe connector flange 170) without hitting any type obstructions. This is contrary to the prior art when separate end drain units had such flow constrictions, such as raised connector lips, or circular end drain openings, for example, present in the fluid flow path. Male end cap drain 166, like male end cap 94, is preferably formed of high density polyethylene.

An additional advantage of the present invention is that, because it preferably is formed as an injection-molded trench drain member 24, rather than as an extruded plastic part (like most of the prior art trench drain designs), the present trench drain member 24 includes an underneath "cavity" 140. Thus, instead of being sealed off during its formation, the cavity 140 can be used (where desired) to accept the strengthening filler material 142 as described above.

Further, if need be, the grate member 26, which is preferably formed of injection molded plastic, can be replaced with a suitably-sized and configured cast iron or stainless steel grate member.

With the present invention, a long run, i.e., series, of trench drain members can extend a long distance, such as several hundred feet or more, since it is the secondary line 40 that needs to be pitched. This is in contrast to prior art "pitched"-type channel drains, which had maximum length runs of say, 150 or 200 feet, before terminating at a collector box and then a new trench run had to be started.

In terms of ease of installation, it is an advantage of the pipe connector flanges 58, 60, 62 of the present invention, including pipe connector flange 170 of the male end cap drain 166, to preferably be sized to directly receive the ends of standard drainage pipe, rather than only the so-called bell ends of pipe fittings, i.e., the ends of plastic pipe elbows and "TS".

From the foregoing, it is believed that those skilled in the art will readily appreciate the unique features and advantages of the present invention over previous types of trench and channel drains. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

I claim:

1. A trench drain unit for draining surface fluids to a remote location, comprising in combination:

an open-topped, elongated trench member having a base portion, a non-pitched, fluid-carrying drainage channel formed with two upstanding wall members, and at least one bottom-draining opening forming in said base portion;

said at least one opening surrounded by at least one downwardly-extending pipe connector flange capable of sealably receiving an auxiliary drainpipe component;

said respective wall members having upper ends providing grate support means;

a grate member spanning said drainage channel and supported on said respective grate support means, said grate member including a plurality of grate openings;

one end of said elongated trench member terminating in a tongue end having a first female configuration;

the other end of said elongated trench member terminating in another tongue end having a male configuration which is complimentary to and interlockingly engageable within said tongue end of said first female configuration; and means provided along said elongated trench member for permitting said trench member to be cut along its length to form a cut end defining a second female configuration which matches said first female configuration, whereby a second trench member can have its tongue end having said male configuration inserted into said second female configuration of said cut end.

2. The invention of claim 1, and including a knock-out member formed in said drainage channel and covering said bottom-draining opening.

3. The invention of claim 1, and a second bottom-draining opening formed in said drainage channel, surrounded by at least a second downwardly-extending pipe connector flange, and covered by a second knock-out member.

4. The invention of claim 1, wherein said at least one pipe connector flange is so sized as to receive the end of a commonly available plastic drainage pipe.

5. The invention of claim 1, and including a plurality of upwardly-extending lug members formed on said respective grate support means.

6. The invention of claim 5, wherein said grate support means comprises grate support ledges.

7. The invention of claim 5, wherein said drainage grate openings are so positioned and configured as to lockably engage said lug members to thereby resist any lateral spreading of said upstanding wall members.

8. The invention of claim 1, and a secondary drain line installed with pitch adjacent said trench member and connected to said at least one opening to thereby drain fluids carried by said drainage channel.

9. The invention of claim 8, wherein said secondary drain line is formed of corrugated plastic pipe.

10. The invention of claim 1, and a male end cap member having an inwardly-projecting male end operable to be encapsulated by and sealably engaged with said female tongue end configuration.

11. The invention of claim 1, and a female end cap member having an inwardly-projecting female end operable to encapsulate and be sealably engaged with said male tongue end configuration.

12. The invention of claim 1, wherein said elongated trench member is formed of injection-molded plastic material.

13. The invention of claim 12, wherein said plastic material is high density polyethylene.

14. The invention of claim 1, wherein the respective sides of said base portion each include a transversely-outwardly extending base extension to thereby provide additional retention support to said trench member.

15. The invention of claim 14, wherein each said base extension is formed so as to have an open-topped area able to accept trench backfill material thereby to further assist in stablizing said trench member.

16. A trench drain unit for draining surface fluids to a remote location, comprising in combination:

an open-topped, elongated trench member having a base portion, a non-pitched, fluid-carrying drainage channel formed with two upstanding wall members, and at least one bottom-draining opening formed in said base portion;

said at least one opening surrounded by at least one downwardly-extending pipe connector flange capable of sealably receiving an auxiliary drainpipe component;

said respective wall members having upper ends providing grate support means;

a grate member spanning said drainage channel and supported on said respective grate support means, said grate member including a plurality of grate openings;

one end of said elongated trench member terminating in a tongue end having a female configuration;

the other end of said elongated trench member terminating in another tongue end having a female configuration which is complimentary to and interlockingly engageable with a said tongue end of said female configuration, wherein the underside of said base portion of said trench member is formed with at least one cavity area and a hardenable filler material formed within said cavity area thereby to provide additional vertical compressive strength to said trench member.

17. The invention of claim 1, wherein the underside of said base portion of said trench member is formed with at least one cavity area, and a plurality of generally vertical-aligned strengthening rib members formed in said cavity area.

18. The invention of claim 1, and including fastener openings formed in said grate member whereby said grate member can be detachably secured to said trench member by fasteners.

19. The invention of claim 1, and wherein said at least one pipe connector flange extends to substantially the same level as said base portion.

20. The invention of claim 14, wherein said base extensions include through holes operable to receive means for fastening said trench member to associated support members during installation of said trench member.

21. The invention of claim 20, wherein said means for fastening said trench member comprise nails, and said support members comprise stake members.

22. The invention of claim 2, and a perforated strainer member covering said at least one opening when said knock-out member has been removed.

23. The invention of claim 1, wherein when a said female configuration end of a first said trench member is interlockingly engaged to a said male configuration end of a second said trench member, whereby a smooth, substantially seamless, extended said drainage channel is created.

24. A universal trench drain comprising in combination:

an elongated, non-pitched trench drain member having an open-topped drainage channel formed by a bottom and two opposed side wall members, at least one bottom-draining opening formed in said drainage channel bottom;

said trench drain member having two terminal ends, the first of said terminal ends having a longitudinally-extending male end configuration, and the second of said terminal ends having a longitudinally-extending female end configuration complimentary to said male end configuration; and a grate member spanning said drainage channel and supported atop said opposed side wall members, said grate member having a plurality of grate openings and the respective said side wall members have grate support ledges upon which said grate member is supported, said support ledges being formed with a plurality of lug members which are so positioned as to respectively lockably engage said plurality of grate openings to thereby cooperate to resist any lateral spreading of said opposed side walls.

25. The invention of claim 24, and including at least one pipe connector flange member formed integrally on said trench drain bottom proximal said bottom-draining opening, said flange member configured so as to sealably receive a commonly available drainpipe component.

26. The invention of claim 25, and a second pipe connector flange member also formed integrally on said trench drain bottom and concentric with said at least one pipe connector flange member, said second flange member so configured as to sealably receive yet a different sized commonly available drainpipe component.

27. The invention of claim 24, wherein said trench drain member includes means along its length such that, when said trench drain member is transversely cut along its length, the resulting cut end has a configuration substantially similar to said female end configuration of said second end of said trench drain member.

28. The invention of claim 24, and a male end cap member having an inwardly-projecting male tongue end so configured as to be sealably encapsulated by said female end configuration of said second end of said trench drain member when engaged thereto.

29. The invention of claim 24, and a female end cap member having an inwardly-projecting female tongue end so configured as to sealably encapsulate said male end configuration of said first end of said trench drain member when engaged thereto.

30. A trench drain component comprising:

an elongated longitudinally extending trench drain member having a generally U-shaped cross-sectional configuration formed from a base and two upstanding side walls;

one end of said trench drain member terminating in an extended male tongue end and the other end of said trench drain member terminating in an extended female end, said female end being capable of sealably receiving said male end of another trench drain member; and said trench drain member including means along a substantial majority of its length for forming a female end when said trench driven member is transversely cut.

31. The invention of claim 30, in which said base has a downwardly-extending annular flange which projects from a bottom of said base, said annular flange being adapted to receive a drain pipe component.

32. The invention of claim 31, in which said base includes a knockout member concentric with an interior of said downwardly-extending annular flange.

33. The invention of claim 30, in which said base includes a pair of concentric, downwardly-extending annular flanges which project from a bottom of said base, said concentric flanges being adapted to receive differently-sized drain pipe components.

34. The invention of claim 33, in which said base includes a knockout member concentric with an interior of the innermost of said concentric flanges.

35. The invention of claim 30, in which said upstanding side walls are integrally formed with said base at one end and terminate in free ends at their other ends, said free ends each forming a grate-supporting ledge.

36. The invention of claim 35, in which said grate-supporting ledges each include a plurality of upstanding, longitudinally spaced apart, lug members.

37. The invention of claim 36, further comprising a grate member which defines a plurality of grate openings, said grate openings being adapted to receive said upstanding lugs on said grate-supporting ledges of said upstanding walls.

38. The invention of claim 30, further comprising a female end cap having a projecting configuration adapted to be releasably, sealably connected to said male end of said trench drain member and a male end cap having a projecting configuration adapted to be releasably sealably connected to said female end of said trench drain member.

39. A trench drain system comprising:

a plurality of elongated longitudinally extending trench drain members connected together in an end-to-end fashion, each of said trench drain members having a generally U-shaped cross-sectional configuration formed from a base and two upstanding side walls;

one end of each of said trench drain members terminating in a male tongue end and the other end of each of the trench drain members terminating in a female tongue end, said female ends being capable of sealably receiving said male ends, each of said trench drain members being sealably connected in an end-to-end longitudinal fashion with adjacent male ends connected to adjacent female ends;

each of said trench drain members including means along a substantial majority of its length for forming a female end when said trench drain member is transversely but and allowing said trench drain members to be cut to fit within a predefined installation space while still providing a free female end; and a female end cap adapted to releasably, sealably connect to the said male end of a said trench drain member at one terminal end of the trench drain system and a male end cap adapted to releasably, sealably connect to the said female end of a said trench drain member at the other terminal end of the trench drain system.

40. The invention of claim 39, in which the said bases of each of said trench drain members includes a downwardly-extending annular flange which projects from a bottom of said base, each of said annular flanges being adapted to receive a drain pipe component.

41. The invention of claim 40, in which each of said bases includes a knockout member concentric with an interior of each of said downwardly-extending annular flanges.

42. The invention of claim 39, in which each of said bases includes a pair of concentric, downwardly-extending annular flanges which project from a bottom of said base, each of said concentric flanges being adapted to receive a drain pipe component therebetween and also to receive a drain pipe component over an outer surface of the outermost of said concentric flanges.

43. The invention of claim 42, in which each of said bases include a knockout member concentric with an interior of the innermost of said concentric flanges.

44. The invention of claim 39, in which each of said upstanding side walls are integrally formed with said base at one end and terminate at free ends at their other ends, said free ends each forming a grate-supporting ledge.

45. The invention of claim 44, in which each of said grate-supporting ledges includes a plurality of upstanding, longitudinally spaced apart, lug members.

46. The invention of claim 45, further comprising a plurality of elongated, longitudinal grate members having a width adapted to fit on said grate-supporting ledges of said upstanding side walls and which define a plurality of grate openings, said grate openings being adapted to receive said upstanding lugs on said grate-supporting ledges.

47. The invention of claim 39, in which said plurality of said trench drain members extend in a longitudinal direction with the top ends of said side walls being flush to grade and said base being formed without pitch, at least one of said knockout members being removed and a drain pipe being connected to the associated said downwardly-extending flange, said drain pipe being connected to a buried drainage pipe which is set at a pitch in the ground to facilitate drainage of surface fluids flowing into said plurality of trench drain members.

48. The invention of claim 39, and wherein said male end cap including an end wall having a drain opening, and an outwardly-extending drain pipe connector flange having an inner dimension larger than said drain opening, whereby a drain pipe sealably connected to said male end cap with said drain opening can be used to end drain said trench drain members.

* * * * *